US005361608A

United States Patent [19]

Salucci et al.

[11] Patent Number: 5,361,608

[45] Date of Patent: Nov. 8, 1994

[54] CIRCULAR KNITTING MACHINE OF ELASTIC NEEDLE TYPE WITH A SLIDER SELECTION DEVICE

[75] Inventors: Paolo Salucci; Jan Ando, both of Scandicci, Italy

[73] Assignee: Savio S.p.A., Pordenone, Italy

[21] Appl. No.: 40,935

[22] Filed: Mar. 31, 1993

[30] Foreign Application Priority Data

Apr. 2, 1992 [IT] Italy ..... MI.92-A/000796

[51] Int. Cl.[5] ..... D04B 15/78

[52] U.S. Cl. ..... 66/220; 66/219

[58] Field of Search ..... 66/215, 216, 217, 218, 66/219, 220, 221

[56] References Cited

U.S. PATENT DOCUMENTS

| | | | |
|---|---|---|---|
| 3,335,581 | 8/1967 | Pernick | 66/50 |
| 3,771,328 | 11/1973 | Schindle et al. | 66/219 |
| 3,812,691 | 5/1974 | Engelfried | 66/219 |
| 3,976,206 | 8/1976 | Mureso | 66/219 |
| 4,615,187 | 10/1986 | Schimko | 66/219 X |
| 5,165,259 | 11/1992 | Negri et al. | 66/219 |
| 5,197,303 | 3/1993 | Aria | 66/217 |

FOREIGN PATENT DOCUMENTS

| | | | |
|---|---|---|---|
| 2231791 | 12/1974 | France . | |
| 2236323 | 2/1974 | Germany . | |
| 1257491 | 12/1971 | United Kingdom | 66/219 |
| 2112822 | 7/1983 | United Kingdom | 66/219 |

*Primary Examiner*—Clifford D. Crowder
*Assistant Examiner*—John J. Calvert
*Attorney, Agent, or Firm*—George P. Hoare, Jr.

[57] ABSTRACT

A circular knitting machine of elastic needle type provided with a cam for flexing all the needles into their trick before they are raised to seize the feed yarn, in which the selection between those needles to be maintained flexed and those needles to be allowed to return to their normal configuration is made by axially slidable sliders positioned below each needle contained in the tricks.

19 Claims, 6 Drawing Sheets

CIRCULAR KNITTING MACHINE OF ELASTIC NEEDLE TYPE WITH A SLIDER SELECTION DEVICE

FIELD OF THE INVENTION

This invention relates to circular knitting machines and in particular to the selection of needles in such machines for the purpose of producing patterned or reinforced knitwork, and provides a device for selecting those needles which are to seize yarn from the various feed stations to form knitwear.

BACKGROUND OF THE INVENTION

Circular knitting machines consist generally of one or two needle cylinders 1 which, as shown in FIG. 1, comprise tricks 2 in their outer cylindrical surface. The tricks represent the guides for the needles 3 which during their vertical travel form the stitch loops in cooperation with the sinkers.

The number of tricks is equal to the number of needles which slide within them with reciprocating motion by the effect of raising and lifting cams not shown in FIG. 1. Generally, in hosiery machines the number of tricks and needles is between 200 and 400. The cylinder is rotated and with it there rotate the needles which during their reciprocating movement are fed with yarn in fixed angular positions when in their highest point of travel by yarn feed stations consisting of one or more yarn guides which are selectively presented to the needle hooks so that they seize the yarn from them.

To produce hosiery articles generally only a fraction of the available needles are used at the same time and in the same manner, except for the plain knitwork parts, for which all the needles are operated between their maximum and minimum level, all being fed with yarn at each knitting course, and all being moved in the same manner.

When the machine is not producing plain knitwork, in order to produce other types of knitwork some needles are required to produce stitch loops and therefore be raised to the maximum level at the feed station in order to seize the yarn, while others have to be raised to an intermediate level to take up yarn without clearing the previous stitch in order to form a tuck stitch, or have to be raised with a certain delay so that they do not seize the yarn fed in that feed station and therefore do not form new loops with it. In other words a needle selection has to be made. This means that before each feed it has to be determined which and how many needles must undergo a certain travel and which and how many other needles must undergo a certain different travel or indeed undergo no travel.

With reference to FIG. 1, in the known art this selection is effected by the jacks 4 which slide in the same tricks 2 as the needles lying above them, to urge the needles upwards and move them to a higher level in order to seize the yarn. After seizing the yarn the needles are controlled in their reciprocating movement by their own cams and counter-cams which are fixed relative to the cylinder, and which are not shown in FIG. 1 but are shown in the subsequent figures.

FIG. 1 shows an elastic jack 4, able to radially flex its lower end. When the jacks 4 have moved the needle into its working position they withdraw from the needle butt and return downwards. If the needle, after completing its task of seizing the yarn and forming the stitch loop and therefore being at its minimum level, is not required to seize a further yarn from another feed it remains at this level until its control jack or other machine members move it upwards again.

The shank of the jack 4 comprises in its middle part a projection 5, i.e. the upper guide butt, which comes into engagement with its own control cam 6 for urging the jack downwards when it has completed its task of raising the needle 3. Proceeding downwards along the jack shank there is a lower butt 7 which comes into engagement with the cam ring 8 provided with a raising contour 9 which raises the jack together with its overlying needle, this thus being selected to seize the yarn, and with a contour 10 which with its inner face engages the vertical face of the butt 7 to urge the foot of the elastic jack 4 into the interior of the trick 2. When in this position of approach to the interior, the butt 7 is unable to engage the raising contour 9 of the ring 8 and the jack remains lowered. The lowering cams 6 and the raising and approach contours 9 and 10 are obviously offset angularly and operate at different times on each jack.

In circular knitting machines, needle selection is generally conducted by maintaining those jacks corresponding to the needles to be raised by the raising butt in a position withdrawn outwards to cause them to engage the raising contours, while maintaining those jacks corresponding to the needles not to be selected in their position of approach to the interior of the trick, whether elastic jacks or conventional rigid jacks are used.

When elastic jacks are used, they tend spontaneously to move their lower butt 7 outwards to engage the raising contour 9 and be raised, whereas with conventional jacks their approach and withdrawal are effected by suitably positioned cams fixed relative to the cylinder.

The jacks 4 are maintained in position so that the flexure or displacement of their lower part does not cause their upper part to escape from the trick, this being achieved for example by one or more circular springs 12 rigid with the cylinder and surrounding their upper part. They are held in position by circumferential grooves in the cylinder, so that the springs lie internal to the face of the needle cylinder 1.

In FIG. 1 the selection device, indicated schematically by 11, can either allow the jack 4 to move outwards and rise on the cam 9, or can urge it into its trick so that it remains low. Conventional selection uses mechanical selectors acting on a series of intermediate butts, but this type of selection has considerable limits in terms both of operation and of the number of possible selections.

The most recent machines use electromagnetic selection devices which allow a greater selection speed and a greater number of programmable selections, with advantages in terms of machine productivity and the greater variety of possible patterns.

These selection devices are divided essentially into two categories, namely fixed devices which do not rotate with the cylinder and are positioned to precede each feed station, and to which the jacks are presented in sequence as they rotate, and selection devices which rotate together with the cylinder (and with its jacks) and which are therefore always positioned at the jacks and can act on them at any moment, rather than only during the very short time in which the jack passes in front of them. This second type of selection is also effected before the jacks pass in front of the feed stations, but there is greater freedom with regard to the requirements of synchronization and the constraints on the time available for the selection, however a larger number of selection actuators are required, these being equal in number to the number of needles rather than to the number of feed stations. Needle selection devices and methods of the two described types, operating on both rigid and elastic jacks, are described in European Patent Applications Publication Nos. 0379234, 0431674, 0441005, 0479371 and Italian patent Application N. 22172 A/90 of the present applicant.

Those methods which use jacks in circular knitting machines for needle selection involve a selection linkage which is complicated and requires a cylinder 1 of sufficient length to contain the needles 3, the jacks 4 and possibly vertical selection actuators, in accordance with the aforestated patent applications.

The object of the present invention is to provide a circular knitting machine which does not use vertically moving jacks 4 and instead effects selection directly on the needles.

DETAILED DESCRIPTION OF THE DRAWINGS

Figure 1:
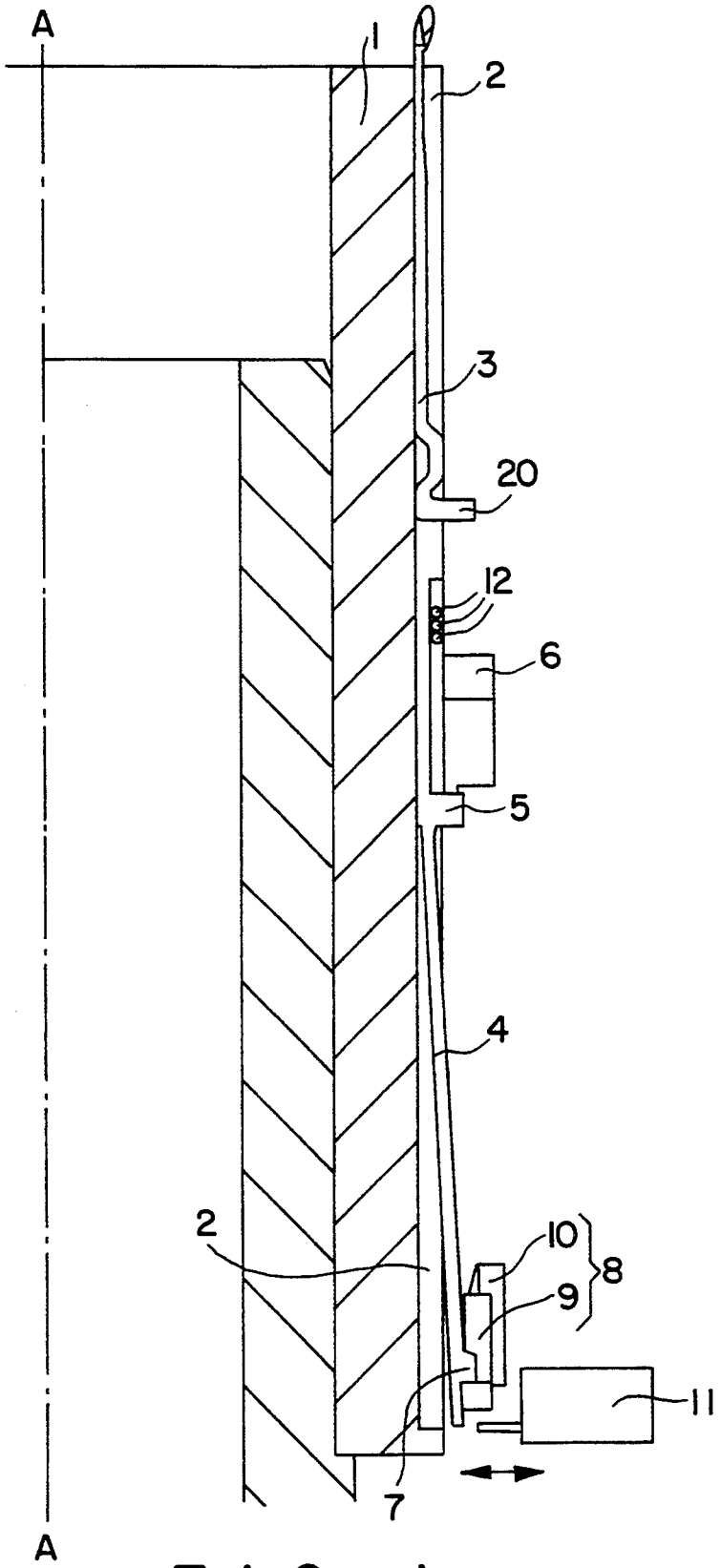
FIG. 1 is a fragmentary sectional elevation view of a circular knitting machine according to the prior art.

The invention provides a circular knitting machine as described hereinafter with reference to FIGS. 2*a* to 7, which show a typical embodiment thereof by way of non-limiting example. According to the scheme of FIGS. 2*a* and 2*b*, the cylinder 1 is provided with tricks having an excavated profile 2*a* which enables the needles 3, which each slide in their own trick, to flex their lower part into the trick and allow their butt 20 to sink into the excavated part 2*a*. The needle flexure is caused by a radial thrust cam 21. The two positions, i.e. flexed and non-flexed, of a needle 3 are indicated in FIGS. 2*b* and 2*a* respectively.

The needle 3 is provided with a butt 20 for engaging its raising and lowering cams. Below the butt 20 there is a nose-shaped projection 22 which engages the nose 24 of a vertical slider 23. During the rotation of the cylinder 1, all the needles 3—when moved downwards by their lowering cam—encounter the cam 21 which flexes all of them and urges their butt 20 inwards. When the needles 3 are in this flexed configuration, their corresponding sliders 23, which slide in the same trick 2, can either be raised or not raised.

If the slider 23 is raised as on FIG. 2*b*—the nose 24 engages with its vertical part the vertical part of the nose 22 of the butt 20 and does not allow the butt 20 to rise on the contour of the cam 25 located in the most outer position relative to the needle cylinder, but only on the contour of the cam 26 which is located closer to the cylinder and is of different shape, as described hereinafter.

Figure 2A:
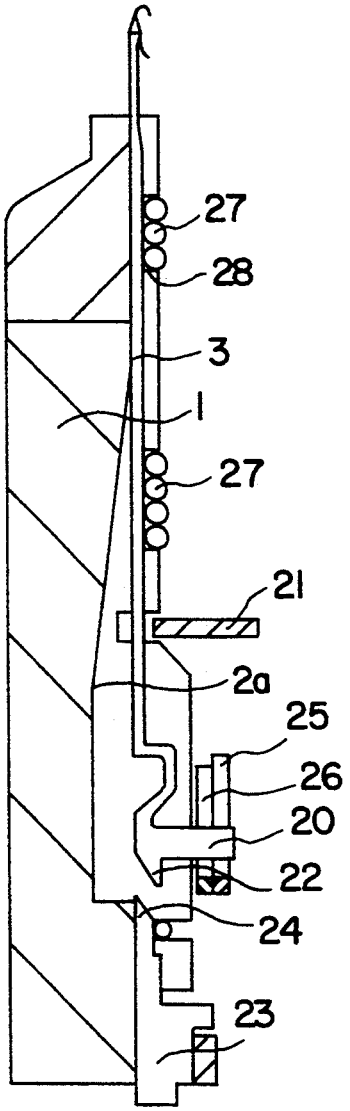
FIG. 2*a* is a fragmentary elevational view of the circular knitting machine according to the invention, showing a sinker in a lowered position.
Figure 2B:
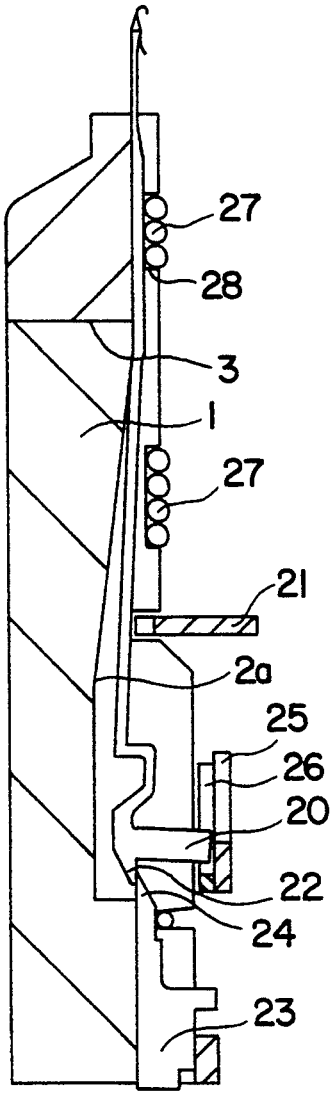
FIG. 2*b* is a fragmentary elevational view of the circular knitting machine of FIG. 2*a*, showing the sinker in a raised position.
Figure 3A:
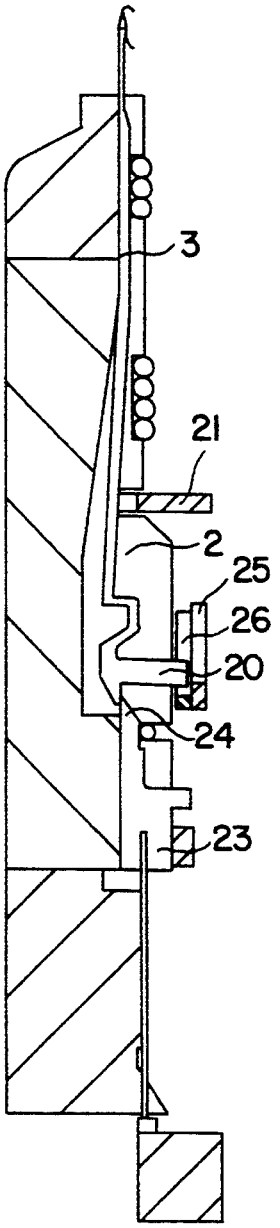
FIG. 3*b* is a schematic lateral detail view of the circular knitting machine of FIG. 3*a*, showing the shape of the cams which move the needles.
Figure 3B:
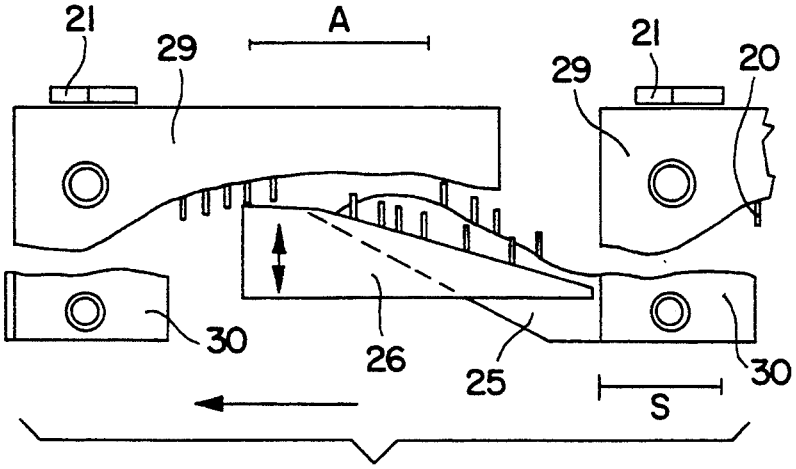

If the slider 23 is not raised—as on FIG. 2*a*—the nose 24 does not hinder the movement of the butt 20, and at the end of the contour of the radial thrust cam 21 the needle spontaneously returns its lower part outwards by virtue of its elasticity, so that it can engage the contour of the cam 25. The needles 3 are retained in position by one or more springs 27 which surround their upper part. These springs are held in position by circumferential grooves 28 in the needle cylinder 1. The springs have to exert a sufficient opposition to the needle flexure force to enable the cams 21 to cause flexure rather than cause the upper part of the needles to emerge from the tricks. FIG. 3*b* is a side view showing the shape of the cams which move the needles. The rotary motion is from right to left. The cams remain at rest and the cylinder rotates with its needles, the butts 20 of which engage the cam contours as they present themselves.

The butt 20 shown on the far right is engaged by the lower descending contour of the cam 29 until its lowest point is reached, at which it encounters the counter-cam 30. In this lowest point of the needle 3, it encounters the inward radial thrust cam 21, and during the action of the cam 21 the slider is either raised or is not raised, hence effecting a selection. The selection region is indicated by the segment S. The selection must be made before the action of the cam 21 ceases and before the needles encounter the assembly comprising the cams 25 and 26. If the needle 3 has not been retained within the trick 2 by its slider 23, it returns outwards and its butt 20 travels along the contour of the cam 25, the contour of which is fairly steep and reaches the initial part of the feed region indicated by the segment A, within which the yarn guides are positioned which present the feed yarn to the hook of the needle 3.

During their rising movement along the cam 25 the needles unload the stitch loops formed during the previous knitting cycle, which move onto the needle shaft, so that only the yarn (or yarns) seized during this raising is present in the needle hook, the previous loop being released on the next lowering of the needle. When the thrust action of the cam 21 ceases, if the butt 20 of the needle 3 is engaged by the slider nose 24, its butt 20 is projecting outwards less than in the previous case. The radial counter-thrust exerted by the flexed needle 3 on the slider 23 is opposed by the circular spring 31 analogous to the springs 27, or alternatively by an equivalent rigid ring.

The butt 20 is therefore unable to rise on the ascending contour of the cam 25, but only on the contour of the cam 26 which is closer to the needle cylinder 1. The path followed by the needles rising on the cam 26 and the knitting produced during this path are hence different from those of the needles travelling along the cam 25.

According to a preferred embodiment of the invention, the cam 26 is provided with an adjustment member to enable it to assume different levels, so as to cause the needles travelling along it to take alternative possible actions.

In the preferred embodiment, the cam 26 occupies substantially all the angular gap available between two consecutive counter-cams 30, in order to form a smooth raising contour and ensure control of the lower position of the needles in each case. A space between the cams 26 and 30 is in any event required for needle mounting and replacement. In place of a fixed cam for limiting needle raising as is known in the art, there is provided an extensive fixed cam 29 to smoothly limit the upward travel of the needles.

The cam 26 can be vertically moved, for example, into three positions by the adjustment member. In the first position the needle selection device can be inactivated, and the needles are all moved to the unloaded stitch level and seize the yarn feeds which are presented to them. In this position the needles unload the stitch and seize a different feed than the needles which have travelled along the cam 25, by rising to the same level as the other needles but with a delay. The smooth contour of the cam 26 enables the machine to work quickly and smoothly with the needle selection inactivated.

In the second position, the needles retain the stitch, i.e. seize the yarn without unloading the previously formed stitch, by rising to an intermediate level. The third position is the lowest position of the cam 26, and allows the needles not put into operation by the selection device to pass low without creating a new stitch, because new yarn has not been seized. The machine operates with the needles either working or at rest, totally on the basis of the jack selection.

The positioning member for the cam 26 is analogous to that for the usual cams known in the art, and can consist for example of a three-position pneumatic cylinder.

During this operation the needles which are not raised, or more precisely their butts 20, then contact the contour of the cam 29, which returns them all downwards to form the stitch loops with the yarns which they have just seized, and to clear the previously formed stitch loops which are carried on their shaft.

The device for needle selection, i.e. for moving the slider 23 between its two alternative positions, can be constructed in various ways provided it offers sufficient performance in terms of speed, accuracy and synchronization.

Figure 4A:
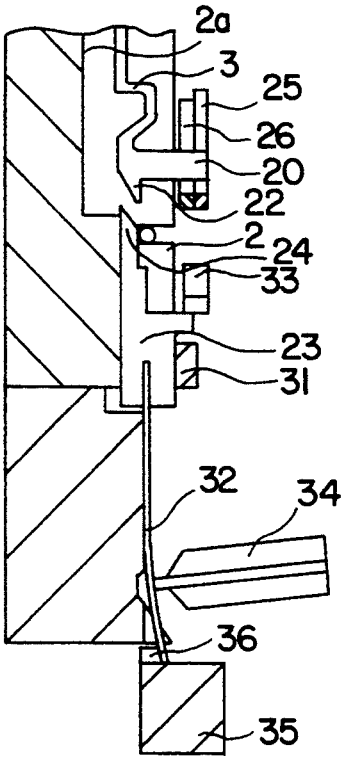
FIG. 4*a* is a sectional elevational detail view of a needle selection device, shown in a position for activating a needle, in the circular knitting machine of FIG. 2*a*.

A preferred embodiment of the present invention which results in high machine productivity and reliability and fully utilizing the benefits deriving from eliminating the jacks from the selection linkage is shown in FIGS. 4*a/b/c*. This construction operates on the basis of the control scheme already used for jack selection described in the previous European Patent Application Publication Nr. 0479371 in the name of the present applicant but are used herein to operate on the needles instead of on the jacks.

Figure 4B:
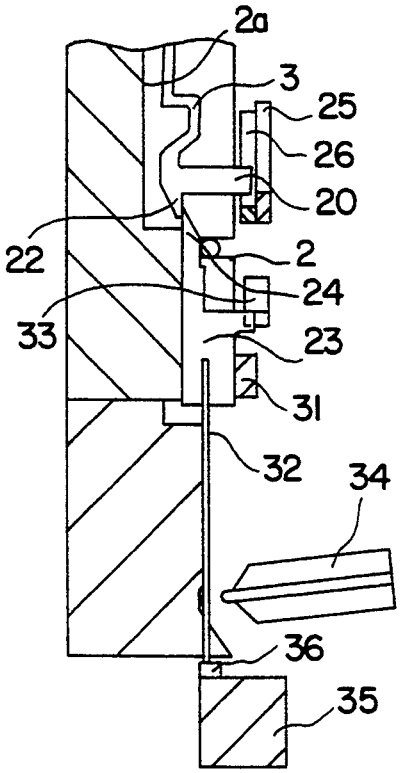
FIG. 4*b* is a sectional elevational detail view of the needle selection device of FIG. 4*a*, shown in a position for retaining a needle.

FIG. 4*a* shows the device in the selection configuration which activates the needle 3 by raising it by means of the cam 25, and FIG. 4*b* shows the device in the configuration for retaining the needle 3. The slider 23 associated with a stem 32 is positioned beneath each needle 3 in the same trick 2. The trick portion comprising the slider 23 can be of different depth, width or profile that the portion in which the needle moves and flexes. The relatively more rigid slider 23 can undergo only axial movement, being restrained by the trick 2, the ring 31 and the contour of its lowering cam 33. The stem 32 is however slender and flexible in the plane of the drawing, and is subjected to the action of an electromagnetic selection device 34 cooperating with a fixed ring 35, shown in the subsequent figures, consisting of a raising contour and an outward radial withdrawal contour 37 for the stem 32, these being angularly offset from each other.

In the embodiment illustrated by way of example in FIGS. 4*a* and 4*b*, the slider 23 and the stem 32 are shown as two separately formed parts connected together by providing in the bottom of the slider a slot in which the upper end of the stem 32 is inserted. The retention of the stem can be achieved by other means, however it is essential that any radial force applied to its lower part causes it to flex. This separate formation results in simpler construction. The slider 23 can perform the same function even if constructed in one piece with the stem 32, for example by blanking.

Figure 4C:
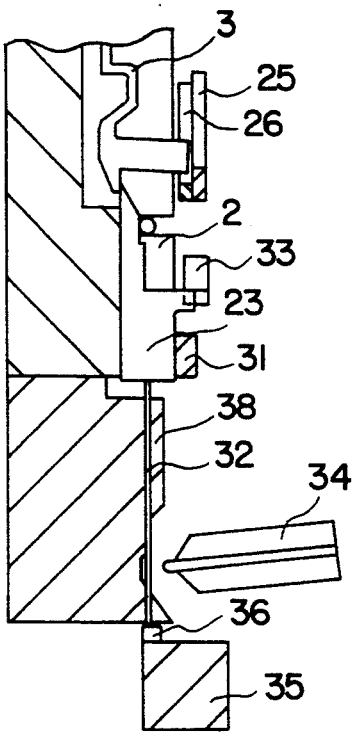
FIG. 4*c* is a sectional elevational detail view illustrating a needle selection control system according to another embodiment of the invention.

FIG. 4*c* shows by way of example a different embodiment of the selection control system, in which the slider and stem are axially independent. The cam 33 axially lowers the slider 23 after this has performed its function, while the stem 32 is retained upperly by the ring 38 so that its lower part flexes by the effect of withdrawal contours on the cam ring 35, and is free to slide axially within its guides.

By way of non-limiting illustration, the electromagnetic selection device 34 consists, in its essential components, of a part magnetized by a permanent magnet 43 which permanently attracts into contact with it the stems 32 flexed by the action of the contour 37, and an interposed part magnetizable by an electromagnet 44, which is either energized or not energized to either release the stems so that they return to their non-flexed position and are able to rise on the contour 36, or to retain them flexed, and away from the next contour 36.

An electromagnetic selection device of this type is significantly illustrated in the Czechoslovakian certificate of author No. 216358.

Figure 5C:
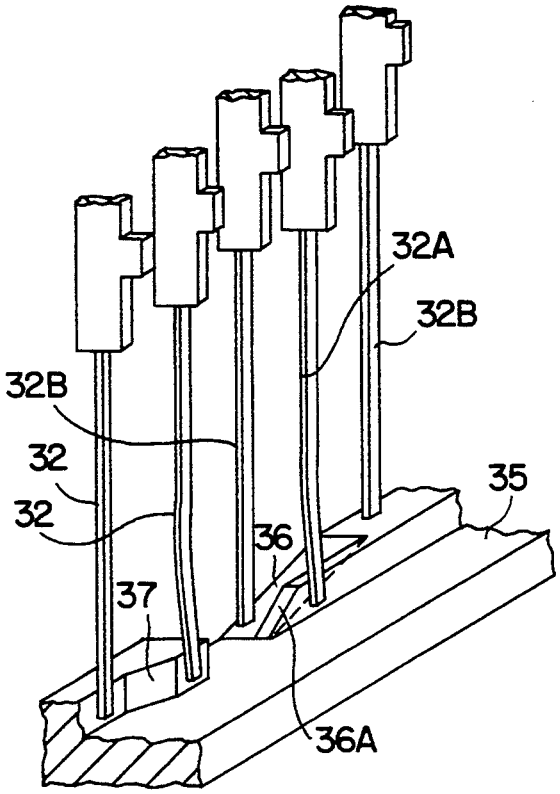
FIG. 5*c* is a schematic perspective view illustrating the relative positions of a fixed cam ring and slider stems in the circular knitting machine of FIG. 5*a*.
Figure 5A:
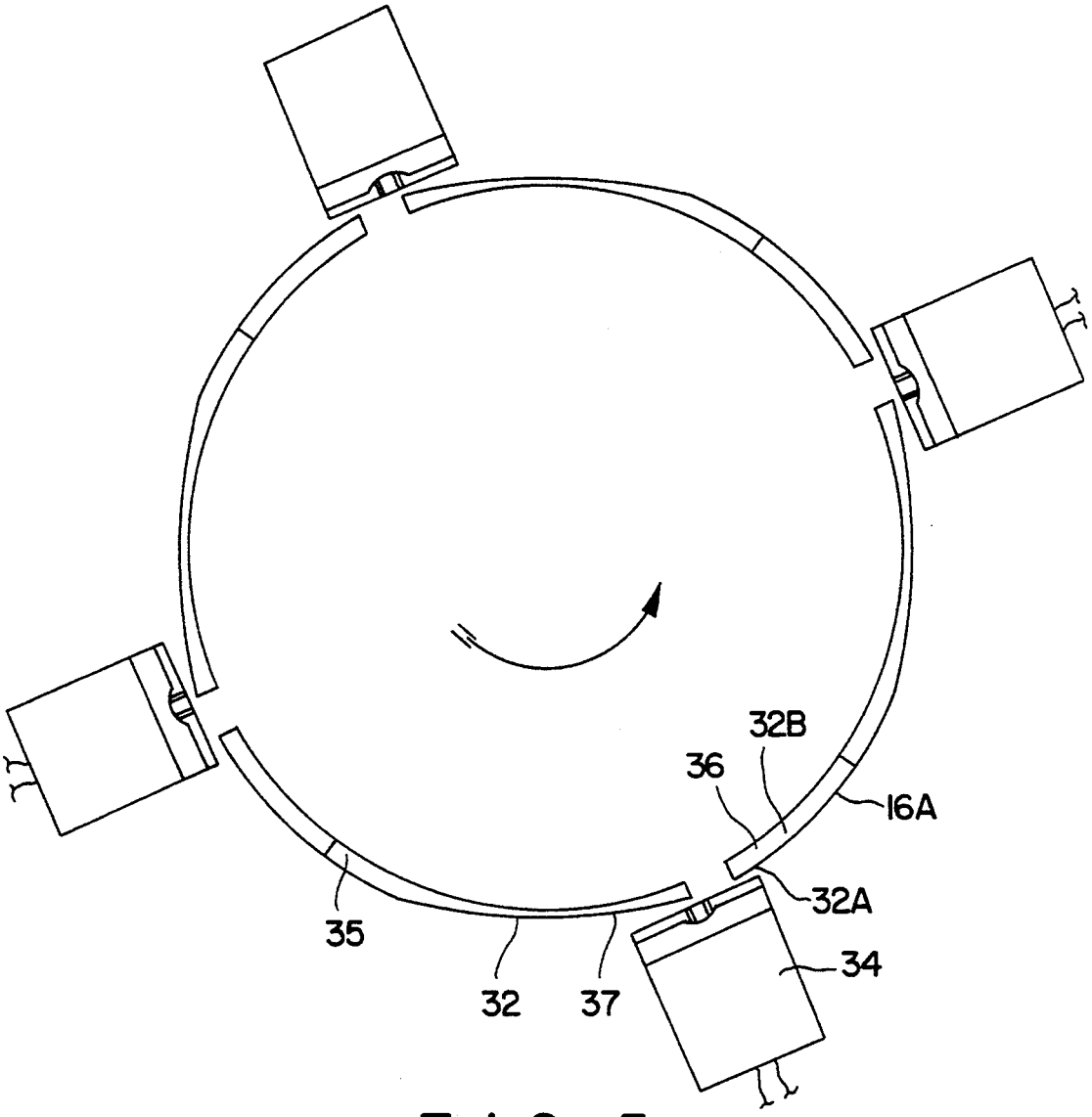
FIG. 5*a* is a schematic plan view illustrating the location of four electromagnetic selection devices with respect to the needle cylinder in the circular knitting machine according to the invention.
Figure 5B:
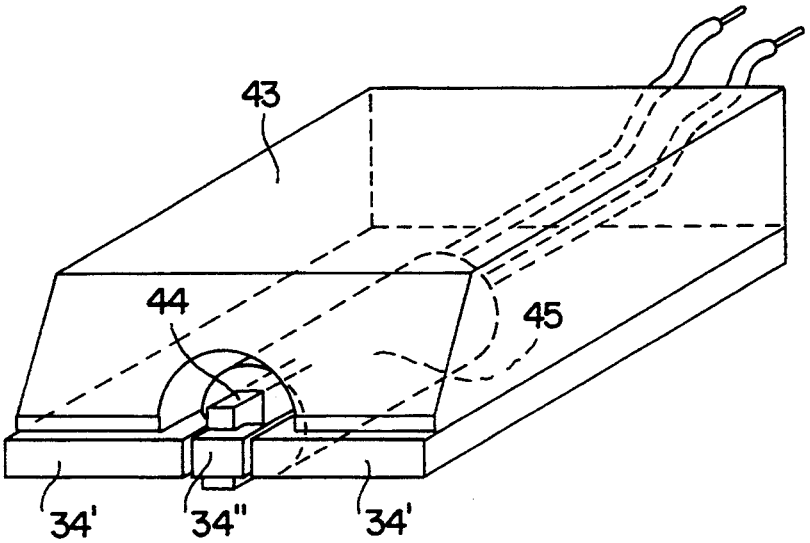
FIG. 5*b* is a schematic perspective view of one of the electromagnetic selection devices shown in FIG. 5*a*.

According to the scheme shown in FIGS. 5*a* and 5*c* the stem 32 travels along the ring 35 with anticlockwise movement to reach the withdrawal cam 37 which flexes it and moves it to the plate of the device 34. This happens for all stems 32 without distinction. The flexed stems 32 travel along the initial part 34' of the device 34 energized by the permanent magnet, remaining in an outwardly flexed position. The contour 37 terminates before that part 34" of the device 34 energized by the action of the electromagnet 44, if this is fed with energization current. FIG. 5*b* shows the structure of a typical embodiment of the device 34 in greater detail.

It consists essentially of a plate of ferromagnetic material of quadrangular annular shape with an inner cavity containing the electromagnet 44. That edge of the plate which is presented to the stems, known as the pole shoe, is divided into two regions, namely an outer region divided into two outer parts 34' connected to the permanent magnet 43, and an inner region 34" connected to the electromagnet 44 and more specifically to the pole piece of its core disposed within the winding 45. The two regions are magnetically separated from each other for example by the insertion of non-magnetic material such as brass. The pole shoe, the edge presented to the stems 32 is preferably protected by an antiwear covering.

According to a preferred embodiment of the invention this antiwear covering is achieved by nickel-plating the edge of the pole show of the selector 34 traversed by the stems. Such a covering has ferromagnetic characteristics, resulting in only a small reduction in magnetic attraction and hence not being restricted to the application of only extremely thin layers, as instead is required by the coverings of diamagnetic materials described in Italian patent 1228404.

Compared with the materials described in that patent, nickel is much less fragile and sensitive to impact, aided by the greater thickness with which it can be applied.

The raising cam 36 is preferably provided with a raised edge 36A which retains the stems 32B on the raising cam and prevents the rising of any stems 32A which have been imperfectly retained by the device 34.

Consequently when the stem 32 of FIG. 4*b* rises, the slider 23 is lifted and prevents the flexible part of the needle 3, which has flexed into the trick 2*a* by the radial thrust of the cam 21, from returning outwards at the end of the cam 21, by engaging its nose 22 with the nose 24 before the action of the cam 21 ceases. The needle can therefore no longer return outwards and engage its butt 20 with the contour of the cam 25, but only with the contour of the cam 26.

In contrast, in FIG. 4*a* the stem 32 in the 32A configuration does not rise and does not cause 23 to rise, so that the two parts 22 and 24 do not mutually engage, with the result that when the thrust of the cam 21 ceases the flexed part of the needle 3 is freely released and the butt 20 engages the contour of the cam 25. On termination of its action by which it locks the needle 3 in the position of exclusion from the cam 25, the slider 23 is returned downwards by the cam 33, which engages a butt on the slider. As stated heretofore, in circular knitting machines there is a requirement for high speed and a consequent problem of limited time available for needle selection.

In the device according to the invention, during the time period in which each stem passes in front of the part 34" of the electromagnetic selection device 34, the electromagnet 44 must be energized in the opposite sense to or same sense as the permanent magnets, or alternatively not energized, and the stem must have the time, if required, to return to its unflexed position before again entering the angular sector of the second part of the region 34'. There is also a space problem in that the needles subjected to selection are very close to each other, with a pitch of 1 mm or even less.

Figure 7A:
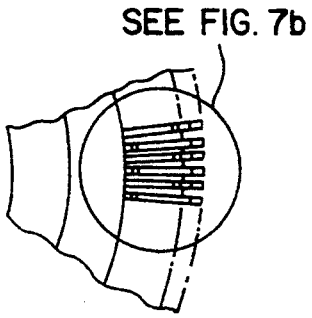
FIG. 7 is a schematic detail plan view of the stems associated with the selection device illustrated in FIG. 6.
Figure 7B:
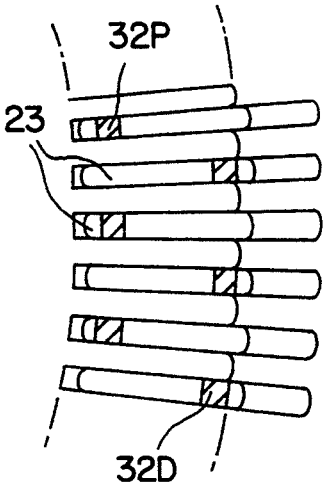
Figure 6:
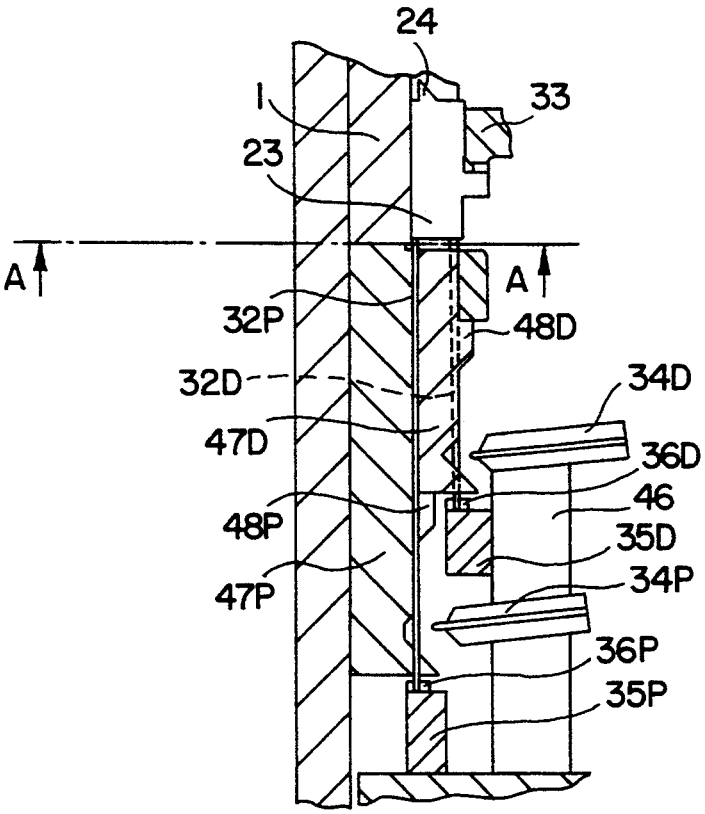
FIG. 6 is a sectional elevational detail view of a needle selection device of the circular knitting machine according to another embodiment of the invention, having stems and selectors arranged on two levels.

The embodiment of FIG. 6 enables the angular space aperture and consequently the time period available for needle selection to be increased, and the device according to the invention be made particularly suitable and reliable for high-speed high-productivity machines, by preventing magnetic interference between adjacent stems. In the embodiment of FIG. 7, stems 32 of different shape alternate mutually, for example those of even number $32^P$ are longer than and more internal than those of odd number $32^D$.

The longer and more internal even stems $32^P$ are selected by the selector $34^P$ located in the lower and more internal position, whereas the shorter and more external odd stems $32^D$ are selected by the selector $34^D$ located in the higher and more external position. The two selectors are positioned on a support frame 46. The stems are guided by concentric grooved ring structures $47^D$ and $47^P$ each provided with staggered grooves $48^D$ and $48^P$ in a number equal to one half of the tricks 2 provided in the needle cylinder. Specifically, the grooves $48^D$ are positioned to correspond with the odd numbered tricks 2, whereas the grooves $48^P$ are positioned to correspond axially with the even numbered tricks 2.

With the stem series $32^D$ there is associated a higher more outer cam ring $35^D$ provided with a withdrawal contour $37^D$ and a raising contour $36^D$, these being shown in FIGS. 5*a* and 5*c* respectively upstream and downstream of the odd stem selector $34^D$. With the even stem series $32^P$ there is associated a lower more inner cam ring $35^P$ likewise provided with contours $37^P$ and $36^P$ upstream and downstream of the even stem selector $34^P$.

The radial distance between the circumferences of the even and odd stems can be indicatively 3–6 mm, whereas the pitch between two corresponding stems to be selected by the same selector is now about 2 mm instead of 1 mm.

These distances, associated with the fact that the stems are contained by the ring structures 47, which are preferably constructed of ferromagnetic material, in practice eliminates possible magnetic interference which might otherwise disturb the selection operation.

The device of the invention, arranged on two levels as shown in FIG. 6, enables the angular width of the space available for needle selection to be doubled. It is apparent that by providing three, four or more levels in the arrangement of the stems and selectors, this space is correspondingly tripled, quadrupled or multiplied.

We claim:

1. Circular knitting machine comprising:

a needle cylinder;

tricks formed in said cylinder;

excavated parts formed in said tricks;

elastic needles having butts and being slidable within said tricks;

a fixed raising cam located at a distance from said cylinder;

a fixed lowering cam located upstream of said raising cam for moving needles to a downward position;

a vertically movable internal spaced cam situated at a lesser distance from said cylinder with respect to said raising cam;

a thrust cam for flexing said needles moved to said downward position by said lowering cam into said excavated parts of said tricks, whereby said butts project a lesser or greater distance from said tricks, with butts of flexed needles thrust into said excavated parts of said tricks being engaged and raised by said vertically movable internal spaced cam, and butts of unflexed needles not engaged by said thrust cam being engaged and raised by said fixed raising cam;

sliders located in said tricks below said needles, each of said sliders being axially movable between a raised position, whereat each said slider retains one of said needles no longer acted on by said thrust cam in a flexed condition thrust into said excavated parts of said tricks, and an unraised position, whereat each of said sliders allows one of said needles no longer acted on by said thrust cam to return to an unflexed condition.

2. Circular knitting machine of claim 1, wherein said vertically movable internal spaced cam is movable between a plurality of levels corresponding to a stitch retaining position, a stitch unloading position, and a position whereat said butts of said needles move along said vertically movable internal spaced cam, said vertically movable internal spaced cam being located proximate to feed stations of said circular knitting machine and having means for raising needles with a substantial delay with respect to needles moving along said fixed raising cam.

3. Circular knitting machine of claim 1, further comprising a nose connected to each of said sliders, and a projection connected to each of said needles below each of said butts, said nose engaging said projection when said sliders are in said raised position for engaging said butts with said vertically movable internal spaced cam and preventing one of said butts from engaging and being raised by said fixed raising cam.

4. Circular knitting machine of claim 1, further comprising a fixed ring located beneath said sliders, a raising contour defined by said fixed ring, an outward radial withdrawal contour defined by said fixed ring and being angularly offset with respect to said raising contour, flexible stems located below each of said sliders and engaging said fixed ring, and a means for flexing said flexible stems.

5. Circular knitting machine of claim 4, wherein said means for flexing said flexible stems include at least one electromagnetic actuation device comprising:

a permanent magnet permanently attracted to said stems;

an electromagnet contained in a plate made of ferromagnetic material;

a pole shoe edge defined by a portion of said plate facing said stems;

an outer region consisting of two outer parts defined by said edge and connected to said permanent magnet;

an inner region defined by said edge and connected to said electromagnet, and magnetic separating means made of non-magnetic material inserted between said outer region and said inner region.

6. Circular knitting machine of claim 5, further comprising anti-wear covering means connected to said edge of said plate facing said stems.

7. Circular knitting machine of claim 4, further comprising a raising cam connected to said fixed ring, said raising cam having a raised edge, said raised edge retaining stems engaging said raising cam and preventing raising of any stem imperfectly retained by said means for flexing said flexible stems.

8. Circular knitting machine of claim 4, wherein said stems include long stems and short stems interposed in an alternate manner between said long stems.

9. Circular knitting machine of claim 8, wherein said means for flexing said flexible stems comprise a support frame and two selectors positioned on said support frame, said selectors including a lower internal selector and a higher external selector, and wherein said long stems are selected by said lower internal selector, and said short stems are selected by said higher external selector.

10. Circular knitting machine of claim 8, wherein a radial distance is defined between said long stems and said short stems, said radial distance being about 3–6 millimeters.

11. Circular knitting machine comprising:

a needle cylinder;

tricks formed in said needle cylinder;

excavated parts formed in said tricks;

elastic needles having butts and being slidable within said tricks;

a fixed raising cam located at a distance from said cylinder;

a fixed lowering cam located upstream of said raising cam for moving needles to a downward position;

a vertically movable internal spaced cam situated at a lesser distance from said cylinder with respect to said raising cam;

a thrust cam for flexing said needles moved to said downward position by said lowering cam into said excavated parts of said tricks, whereby said butts project a lesser or greater distance from said tricks, butts of flexed needles thrust into said excavated parts of said tricks being engaged and raised by said vertically movable internal spaced cam, butts of unflexed needles not engaged by said thrust cam being engaged and raised by said fixed raising cam;

sliders located in said tricks below said needles, each of said sliders being axially movable between a raised position, whereat each said slider retains one of said needles no longer acted on by said thrust cam in a flexed condition thrust into said excavated parts of said tricks, and an unraised position, whereat each of said sliders allows one of said needles no longer acted on by said thrust cam to return to an unflexed condition;

engagement means connected to each of said sliders, and an engageable member connected to each of said needles beneath said butts, said engagement means engaging said engageable member when said slider is in said raised position for engaging said butts with said vertically movable internal spaced cam and preventing said butts from engaging and being raised by said fixed raising cam.

12. Circular knitting machine of claim 11, wherein said vertically movable internal spaced cam is movable between a plurality of levels corresponding to a stitch retaining position, a stitch unloading position, and a position whereat said butts of said needles move along said vertically movable internal spaced cam, said vertically movable internal spaced cam being located proximate to feed stations of said circular knitting machine and having means for raising needles with a substantial delay with respect to needles moving along said fixed raising cam.

13. Circular knitting machine of claim 11, further comprising a fixed ring located beneath said sliders, a raising contour defined by said fixed ring, an outward radial withdrawal contour defined by said fixed ring and angularly offset with respect to said raising contour, flexible stems located below each of said sliders and engaging said fixed ring, and electromagnetic means for flexing said flexible stems.

14. Circular knitting machine of claim 13, wherein said electromagnetic means for flexing said flexible stems include at least one electromagnetic actuation device comprising:

a permanent magnet permanently attracted to said stems;

an electromagnet contained in a plate made of ferromagnetic material;

a pole shoe edge defined by a portion of said plate facing said stems;

an outer region consisting of two outer parts defined by said edge and connected to said permanent magnet;

an inner region defined by said edge and connected to said electromagnet, and magnetic separating means made of non-magnetic material inserted between said outer region and said inner region.

15. Circular knitting machine of claim 14 further comprising anti-wear covering made of nickel, said anti-wear covering being connected to said edge of said place facing said stems.

16. Circular knitting machine of claim 13, further comprising a raising cam connected to said fixed ring, said raising cam having a raised edge, said raised edge retaining stems engaging said raising cam and preventing raising of any stem imperfectly retained by said means for flexing said flexible stems.

17. Circular knitting machine of claim 13, wherein said stems include long stems and short stems interposed in an alternate manner between said long stems.

18. Circular knitting machine of claim 17, wherein said means for flexing said flexible stems comprise a support frame and two selectors positioned on said support frame, said selectors including a lower internal selector and a higher external selector, and wherein said long stems are selected by said lower internal selector, and said short stems are selected by said higher external selector.

19. Circular knitting machine of claim 17, wherein a radial distance is defined between said long stems and said short stems, said radial distance being about 3–6 millimeters.

* * * * *